US009889339B2

(12) United States Patent
Douglass

(10) Patent No.: US 9,889,339 B2
(45) Date of Patent: Feb. 13, 2018

(54) EXERCISE DEVICE WITH FIRST AND SECOND TRAMPOLINE MATS AT DIFFERENT HEIGHTS

(71) Applicant: ICON Health & Fitness, Inc., Logan, UT (US)

(72) Inventor: Melanie Douglass, Newton, UT (US)

(73) Assignee: ICON Health & Fitness, Inc., Logan, UT (US)

( * ) Notice: Subject to any disclaimer, the term of this patent is extended or adjusted under 35 U.S.C. 154(b) by 0 days.

(21) Appl. No.: 15/099,028

(22) Filed: Apr. 14, 2016

(65) Prior Publication Data

US 2016/0303423 A1 Oct. 20, 2016

Related U.S. Application Data

(60) Provisional application No. 62/149,357, filed on Apr. 17, 2015.

(51) Int. Cl.
*A63B 21/00* (2006.01)
*A63B 21/02* (2006.01)
(Continued)

(52) U.S. Cl.
CPC ..... *A63B 23/0405* (2013.01); *A63B 5/11* (2013.01); *A63B 21/00047* (2013.01);
(Continued)

(58) Field of Classification Search
CPC .... A63B 5/00; A63B 5/08; A63B 5/11; A63B 2005/085; A63B 6/00; A63B 21/00047; A63B 21/0005; A63B 21/00054; A63B 21/00058; A63B 21/00061; A63B 21/00065; A63B 21/00178; A63B 21/00181; A63B 21/00185; A63B 21/002;
(Continued)

(56) References Cited

U.S. PATENT DOCUMENTS 1,747,721 A * 2/1930 Lowman ..... A63B 4/00 482/34
2,324,970 A 7/1943 Woolley
(Continued)

FOREIGN PATENT DOCUMENTS

CN 201710954 1/2011
CN 202538226 11/2012
(Continued)

OTHER PUBLICATIONS

Taiwan Search Report issued in Taiwan Invention Patent Application 105112024 dated Dec. 16, 2016.
(Continued)

*Primary Examiner* — Loan H Thanh
*Assistant Examiner* — Gary D Urbiel Goldner
(74) *Attorney, Agent, or Firm* — Holland & Hart LLP

(57) ABSTRACT

A stepping device includes a first step tread at a first step height and defining a first opening, and a first trampoline mat suspended within the first opening. The stepping device also includes a second step tread at a second step height which is spaced apart at a single riser height from the first step height. The second step tread defines a second opening and a second trampoline mat is suspended within the second opening.

21 Claims, 5 Drawing Sheets

(51) Int. Cl.

| | |
|---|---|
| ***A63B 21/055*** | (2006.01) |
| ***A63B 21/068*** | (2006.01) |
| ***A63B 23/04*** | (2006.01) |
| ***A63B 26/00*** | (2006.01) |
| ***A63B 5/11*** | (2006.01) |

(52) U.S. Cl.
CPC ..... *A63B 21/068* (2013.01); *A63B 23/0458* (2013.01); *A63B 21/00061* (2013.01); *A63B 21/023* (2013.01); *A63B 21/0552* (2013.01); *A63B 21/4033* (2015.10); *A63B 21/4034* (2015.10); *A63B 26/003* (2013.01); *A63B 2209/00* (2013.01); *A63B 2210/50* (2013.01)

(58) Field of Classification Search
CPC ... A63B 21/0023; A63B 21/02; A63B 21/023; A63B 21/025; A63B 21/04; A63B 21/0407; A63B 21/0414; A63B 21/0421; A63B 21/0428; A63B 21/0435; A63B 21/0442; A63B 21/055; A63B 21/0552; A63B 21/0555; A63B 21/0557; A63B 21/068; A63B 21/15; A63B 21/151; A63B 21/4027; A63B 21/4029; A63B 21/4033; A63B 21/4034; A63B 21/4037; A63B 22/0046; A63B 22/14; A63B 23/035; A63B 23/03508; A63B 23/03516; A63B 23/03525; A63B 23/04; A63B 23/0405; A63B 23/0458; A63B 23/0464; A63B 23/0482; A63B 23/0494; A63B 23/08; A63B 23/10; A63B 26/00; A63B 26/003; A63B 69/0035; A63B 2208/02; A63B 2208/0204; A63B 2208/0209; A63B 2208/0223; A63B 2244/08
See application file for complete search history.

(56) References Cited

U.S. PATENT DOCUMENTS

| | | | | | |
|---|---|---|---|---|---|
| 3,310,305 | A | | 3/1967 | Howe | |
| 3,892,403 | A | * | 7/1975 | Green | A63B 5/11 182/139 |
| 4,199,136 | A | * | 4/1980 | Mansfield | A63B 5/08 482/26 |
| 4,336,933 | A | * | 6/1982 | Appelbaum | A63B 69/0035 482/29 |
| 4,489,933 | A | * | 12/1984 | Fisher | A63B 5/11 482/147 |
| 5,277,675 | A | * | 1/1994 | Shifferaw | A63B 5/08 482/142 |
| 5,474,509 | A | * | 12/1995 | Hodgdon | A63B 23/0458 482/142 |
| 5,518,476 | A | | 5/1996 | Mcleod | |
| 5,533,948 | A | | 7/1996 | Wilkinson | |
| 5,637,057 | A | * | 6/1997 | Collura | A63B 5/11 482/27 |
| 5,645,510 | A | | 7/1997 | Wilkinson | |
| 5,853,352 | A | * | 12/1998 | Login | A63B 6/00 482/23 |
| 6,045,489 | A | * | 4/2000 | Levine | A63B 22/205 482/112 |
| 6,071,213 | A | * | 6/2000 | Raasch | A63B 5/11 220/9.4 |
| 6,132,338 | A | * | 10/2000 | Shifferaw | A63B 5/08 482/30 |
| 6,162,061 | A | * | 12/2000 | Taylor | A63B 5/11 434/253 |
| D561,849 | S | | 2/2008 | Piaget et al. | |
| 7,335,146 | B2 | * | 2/2008 | Gerstung | A63B 69/0035 482/142 |
| 7,431,679 | B1 | * | 10/2008 | Tageant | A47C 19/024 482/27 |
| 7,520,840 | B2 | | 4/2009 | Shifferaw | |
| 7,722,506 | B2 | * | 5/2010 | Pratson | A63B 21/068 273/458 |
| 7,833,132 | B2 | * | 11/2010 | Hylbert | A63B 5/11 482/27 |
| 8,002,282 | B1 | * | 8/2011 | Koski | A63B 63/083 273/317 |
| 8,323,154 | B1 | | 12/2012 | Bolillo | |
| D701,653 | S | * | 3/2014 | Martinez | D30/118 |
| 8,668,190 | B1 | * | 3/2014 | Heruska | A63B 5/11 188/372 |
| 2003/0125163 | A1 | * | 7/2003 | Plante | A63B 5/11 482/27 |
| 2004/0058781 | A1 | * | 3/2004 | Plante | A63B 5/11 482/27 |
| 2005/0148433 | A1 | * | 7/2005 | Wang | A63B 5/11 482/27 |
| 2006/0272230 | A1 | | 12/2006 | Elwood | |
| 2010/0081549 | A1 | * | 4/2010 | Thompson | A63B 5/11 482/27 |
| 2012/0238409 | A1 | * | 9/2012 | Halsey | A63B 22/04 482/52 |
| 2012/0244997 | A1 | * | 9/2012 | Thompson | A63B 5/11 482/27 |
| 2014/0005003 | A1 | | 1/2014 | Howell | |
| 2014/0179492 | A1 | * | 6/2014 | Wilkins | A63B 71/0619 482/27 |
| 2014/0256525 | A1 | * | 9/2014 | Mueller | A61H 1/0237 482/142 |
| 2014/0366268 | A1 | * | 12/2014 | Revell | A47C 23/007 5/411 |
| 2016/0144290 | A1 | * | 5/2016 | Foote | A63J 5/02 472/76 |

FOREIGN PATENT DOCUMENTS

| | | | | |
|---|---|---|---|---|
| CN | 203264136 | | 11/2013 | |
| KR | 101322039 | | 10/2013 | |
| KR | 2015141012 | A * | 12/2015 | A63B 5/11 |

OTHER PUBLICATIONS

Written Opinion and Search Report issued in PCT/US2016/027606 dated Jul. 25, 2016.
Orbit English translation of Abstract of CN202538226. Nov. 21, 2012.
Orbit English translation of Abstract of CN201710954. Jan. 11, 2011.
Orbit English translation of Abstract of KR101322039. Oct. 28, 2013.

* cited by examiner

EXERCISE DEVICE WITH FIRST AND SECOND TRAMPOLINE MATS AT DIFFERENT HEIGHTS

RELATED APPLICATIONS

This application claims priority to U.S. Patent Application Ser. No. 62/149,357 titled "Exercise Device with First and Second Trampoline Mats at Different Heights" and filed on 17 Apr. 2015, which application is herein incorporated by reference for all that it discloses.

BACKGROUND

Aerobic exercise is a popular form of exercise that improves one's cardiovascular health by reducing blood pressure and providing other benefits to the human body. Aerobic exercise generally involves low intensity physical exertion over a long duration of time. Generally, the human body can adequately supply enough oxygen to meet the body's demands at the intensity levels involved with aerobic exercise. Popular forms of aerobic exercise include running, jogging, swimming, and cycling among others activities. In contrast, anaerobic exercise often involves high intensity exercises over a short duration of time. Popular forms of anaerobic exercise include strength training and short distance running.

Many choose to perform aerobic exercises indoors, such as in a gym or their home. Often, an individual uses an aerobic exercise machine to achieve an aerobic workout indoors. One such type of aerobic exercise machine is an aerobic stepper, which often includes a box that facilitates the user stepping up and down for a workout. Other popular exercise machines that allow a user to perform aerobic exercises indoors include treadmills, rowing machines, stepper machines, and stationary bikes, to name a few.

One type of stepping device is disclosed in U.S. Pat. No. 5,533,948 issued to William T. Wilkinson, et al. In this reference, a combination exercise device includes a trampoline which has a peripheral frame and a resiliently mounted spring member secured to the frame with an upper surface upon which the user may jump. Feet are mounted to the frame for elevating the spring member. The exercise device also includes a horizontal rigid platform upon which the user may repeatedly step on and off in an aerobic exercise. The trampoline is selectively mounted with respect to the step so that the upper surface of the spring member of the trampoline is selectively disposed above the platform at a sufficient distance to permit the trampoline to be used while mounted over the spring member. In other stages of use the trampoline is removed from the step so that the step may be used in an exercise mode. Alternatively, the trampoline may be of a sufficiently small size that the step and trampoline could be permanently mounted together and both types of exercises could then be selectively performed. Other types of exercise machines are disclosed in U.S. Pat. No. 5,645,510 issued to William T. Wilkinson, et al.; U.S. Pat. No. 7,520,840 issued to Tessema Dosho Shifferaw; and U.S. Pat. No. 8,323,154 issued to Mathieu Anthony Bolillo.

SUMMARY

In the preferred embodiment of the present invention, a stepping device includes a first step tread at a first step height defining a first opening and a first trampoline mat suspended within the first opening. The stepping device also includes a second step tread at a second step height which is spaced a single riser height from the first step height. The second step tread defines a second opening and a second trampoline mat is suspended within the second opening.

In one aspect of the invention, the single riser height is between 3.0 to 9.0 inches.

In one aspect of the invention, the single riser height is between 4.5 to 7.0 inches.

In one aspect of the invention, the stepping device further includes a first resilient connector that connects the first trampoline mat to the first step tread, and a second resilient connector that connects the second trampoline mat to the second step tread.

In one aspect of the invention, at least one of the first resilient connector and the second resilient connector exhibit a spring force when under tension.

In one aspect of the invention, the first step height is 1.5 feet or less.

In one aspect of the invention, the first step height is 11.0 inches or less.

In one aspect of the invention, the second step height is 7.0 inches or less.

In one aspect of the invention, the second step height is 5.0 inches or less.

In one aspect of the invention, the first step tread is aligned with the second step tread.

In one aspect of the invention, the first step tread is offset from the second step tread.

In one aspect of the invention, the first step tread is contiguous with the second step.

In one aspect of the invention, the stepping device further includes a third step tread.

In one aspect of the invention, the third step tread defining a third opening, and the third step tread further including a third trampoline mat suspended in the third opening.

In one aspect of the invention, the third step tread is located at the second height.

In one aspect of the invention, a stepping device includes a first step tread at the first step height defining a first opening.

In one aspect of the invention, the stepping device includes a first trampoline mat suspended within the first opening.

In one aspect of the invention, the stepping device includes a second step tread at a second step height which is spaced apart at a single riser height from the first step height.

In one aspect of the invention, the stepping device includes a second opening defined by the second step tread.

In one aspect of the invention, the stepping device includes a second trampoline mat suspended within the second opening.

In one aspect of the invention, the stepping device includes a first resilient connector that connects the first trampoline mat to the first step tread.

In one aspect of the invention, the stepping device includes a second resilient connector that connects the second trampoline mat to the second step tread.

In one aspect of the invention, the stepping device includes at least one of the first resilient connector and the second resilient connector exhibit a spring force when under tension.

In one aspect of the invention, the first step tread is offset from the second step tread and is contiguous with the second step.

In one aspect of the invention, the single riser height is between 4.5 to 7.0 inches.

In one aspect of the invention, the first step height is 11.0 inches or less.

In one aspect of the invention, the second step height is 5.0 inches or less.

In one aspect of the invention, the first step tread is aligned with the second step tread.

In one aspect of the invention, a stepping device includes a first step tread at the first step height that is 11.0 inches or less, the first step tread defining a first opening.

In one aspect of the invention, the stepping device includes a first trampoline mat suspended within the first opening.

In one aspect of the invention, the stepping device includes a second step tread at a second step height which is spaced apart at a height between 4.5 and 7.0 inches from the first step height, the second height being 5.0 inches or less.

In one aspect of the invention, the stepping device includes a second opening defined by the second step tread.

In one aspect of the invention, the stepping device includes a second trampoline mat suspended within the second opening.

In one aspect of the invention, a first resilient connector that connects the first trampoline mat to the first step tread.

In one aspect of the invention, a second resilient connector connects the second trampoline mat to the second step tread.

In one aspect of the invention, at least one of the first resilient connector and the second resilient connector exhibit a spring force when under tension.

In one aspect of the invention, the first step tread is offset from the second step tread and is contiguous with the second step.

BRIEF DESCRIPTION OF THE DRAWINGS

The accompanying drawings illustrate various embodiments of the present apparatus and are a part of the specification. The illustrated embodiments are merely examples of the present apparatus and do not limit the scope thereof.

Throughout the drawings, identical reference numbers designate similar, but not necessarily identical, elements.

DETAILED DESCRIPTION

For purposes of this disclosure, the term "aligned" shall be interpreted as meaning parallel, substantially parallel, or forming an angle of less than 35.0 degrees. For purposes of this disclosure, the term "transverse" means perpendicular, substantially perpendicular, or forming an angle between 55.0 and 125.0 degrees. For the purposes of this disclosure, the term "riser height" means the distance from a first step tread to the next contiguous step tread where there are no intermediate step treads therebetween.

Figure 1:
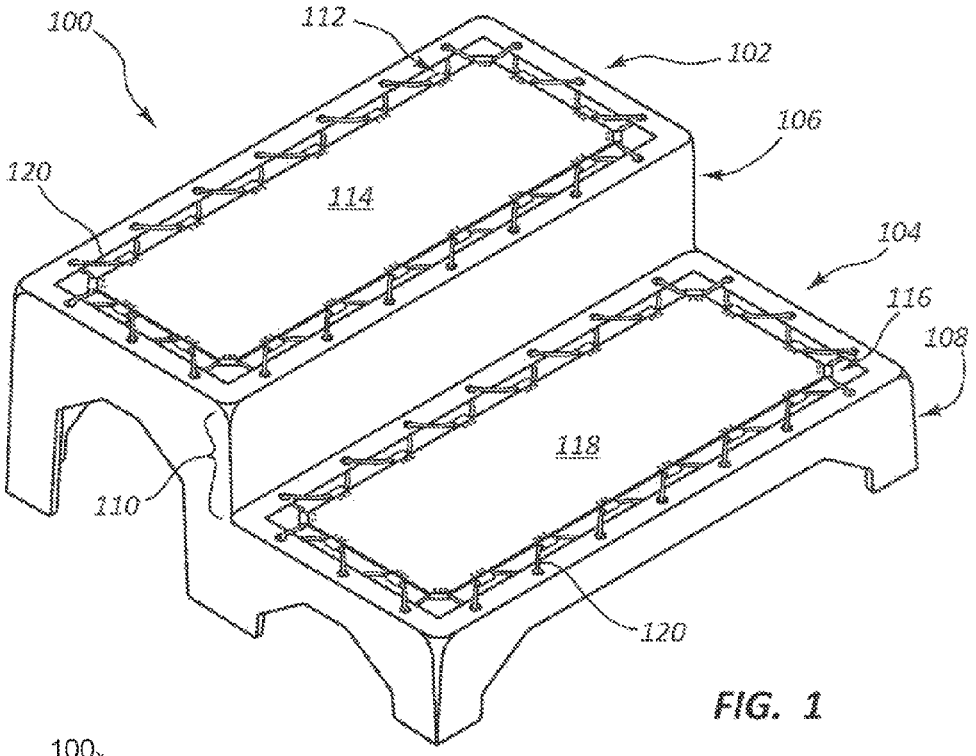
FIG. 1 illustrates a perspective view of an example stepper device in accordance with the present disclosure.

Particularly, with reference to the figures, FIG. 1 depicts an example of an exercise based stepping device 100. In this example, the stepping device includes a first step tread 102 and a second step tread 104. The first step tread 102 is located at a first height 106 relative to the ground or supporting surface (not shown), and the second step tread is located at a second height 108 relative to the ground or supporting surface (not shown). The first and second step treads are separated by a single riser height 110.

The first step tread 102 defines a first opening 112, and a first trampoline mat 114 is elastically suspended in the first opening 112. The second step tread 104 also defines a second opening 116 and a second trampoline mat 118 is suspended in the second opening 116. The first trampoline mat 114 is connected to the first step tread 102 with one or more resilient connectors 120. Likewise, the second trampoline mat 118 is connected to the second step tread 104 with one or more resilient connectors 120.

In the example illustrated in FIG. 1, the one or more resilient connectors 120 is shown as being an elastic cord that spirally connects the respective step tread to the respective mat.

Figure 2:
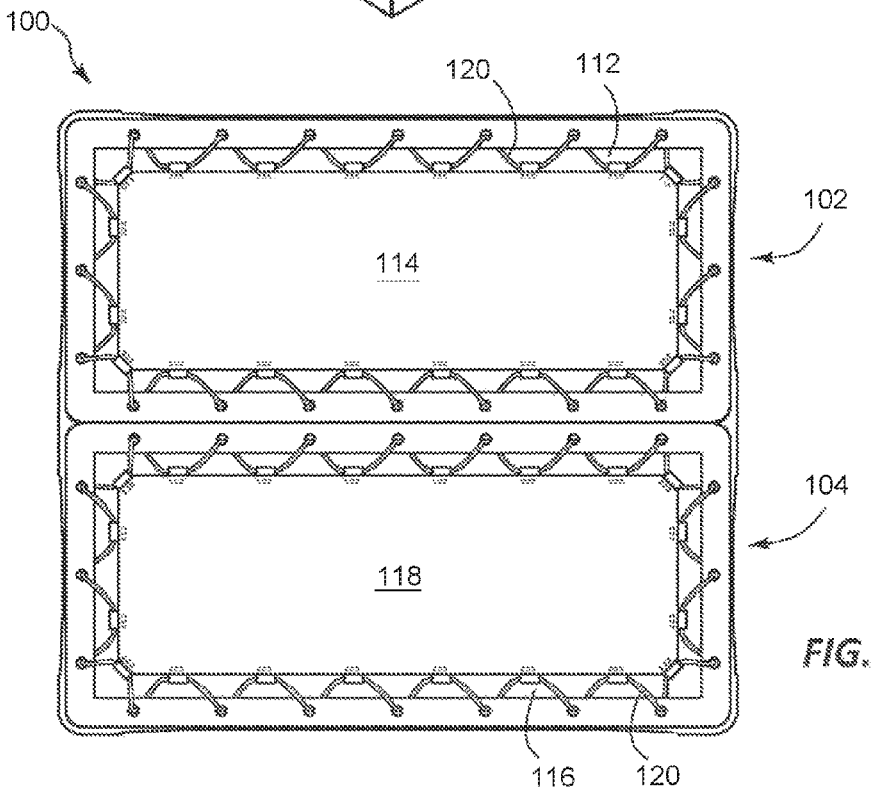
FIG. 2 illustrates a top view of an example stepper device in accordance with the present disclosure.

FIG. 2 depicts a top view of an example of a stepping device 100. In this example, the stepping device includes a first step tread 102 and a second step tread 104. The first step tread 102 defines a first opening 112, and the second step tread 104 defines a second opening 116. A first trampoline mat 114 is suspended in the first opening 112, and a second trampoline mat 118 is suspended in the second opening 116. The first and second trampoline mats 114, 118 are offset from each other. In other words, in this example, the first trampoline mat 114 is not superjacent to the second trampoline mat 118.

Resilient connectors 120 connect the respect trampoline mat to the respective step tread. In this example, the resilient connectors 120 include a plurality of elastic cords 216 that connects the respective step tread to the respective mat in a zigzag pattern.

Figure 3:
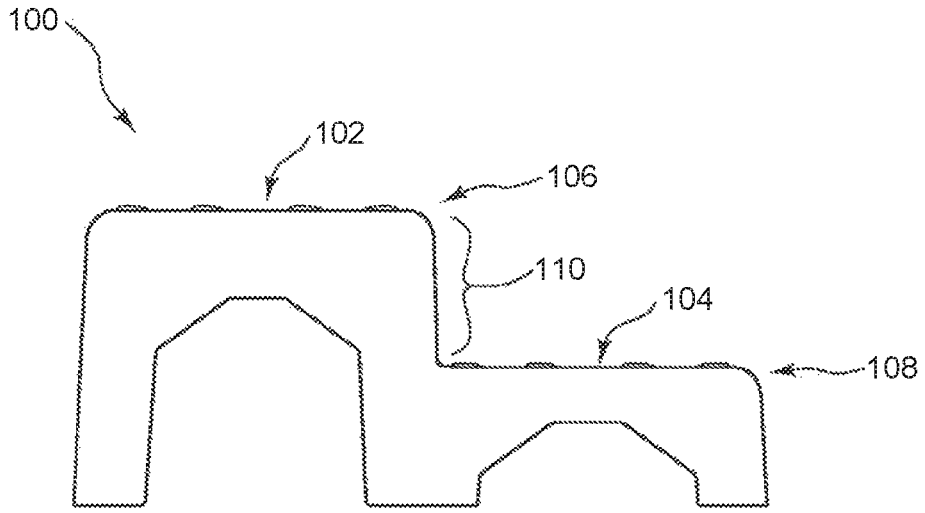
FIG. 3 illustrates a side view of an example stepper device in accordance with the present disclosure.

FIG. 3 depicts a side view of an example of a stepping device 100. In this example, the stepping device includes a first step tread 102 at a first height 106 and a second step tread 104 at a second height 108. The first and second step treads 102, 104 are offset from each other. In other words, in this example, the first step tread 102 is not superjacent to the second step tread 104. The first and second step treads 102, 104 are vertically separated by a riser height 110.

Figure 4:
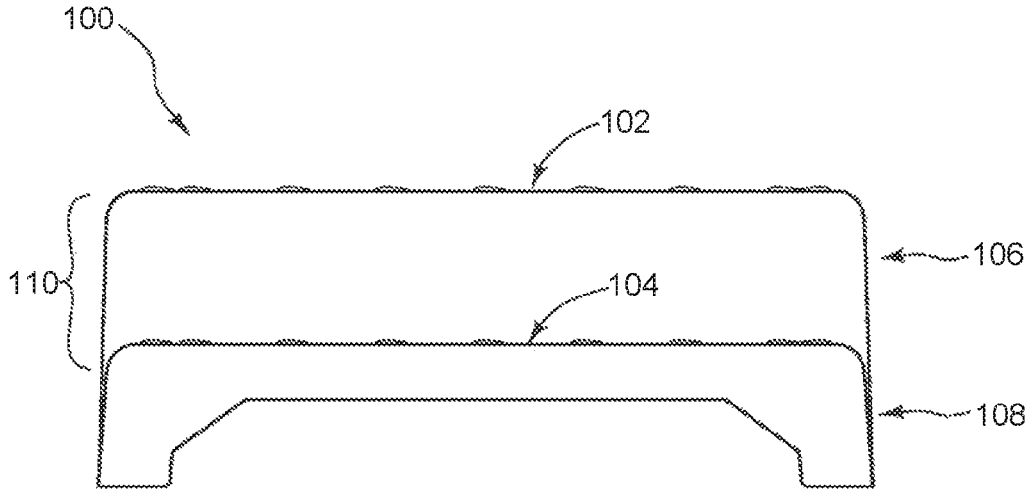
FIG. 4 illustrates a front view of an example stepper device in accordance with the present disclosure.

FIG. 4 depicts a front view of an example of a stepping device 100. In this example, the stepping includes a first step tread 102 at a first height 106 and a second step tread 104 at a second height 108. The first and second step treads 102, 104 are vertically separated by a riser height 110.

Figure 5:
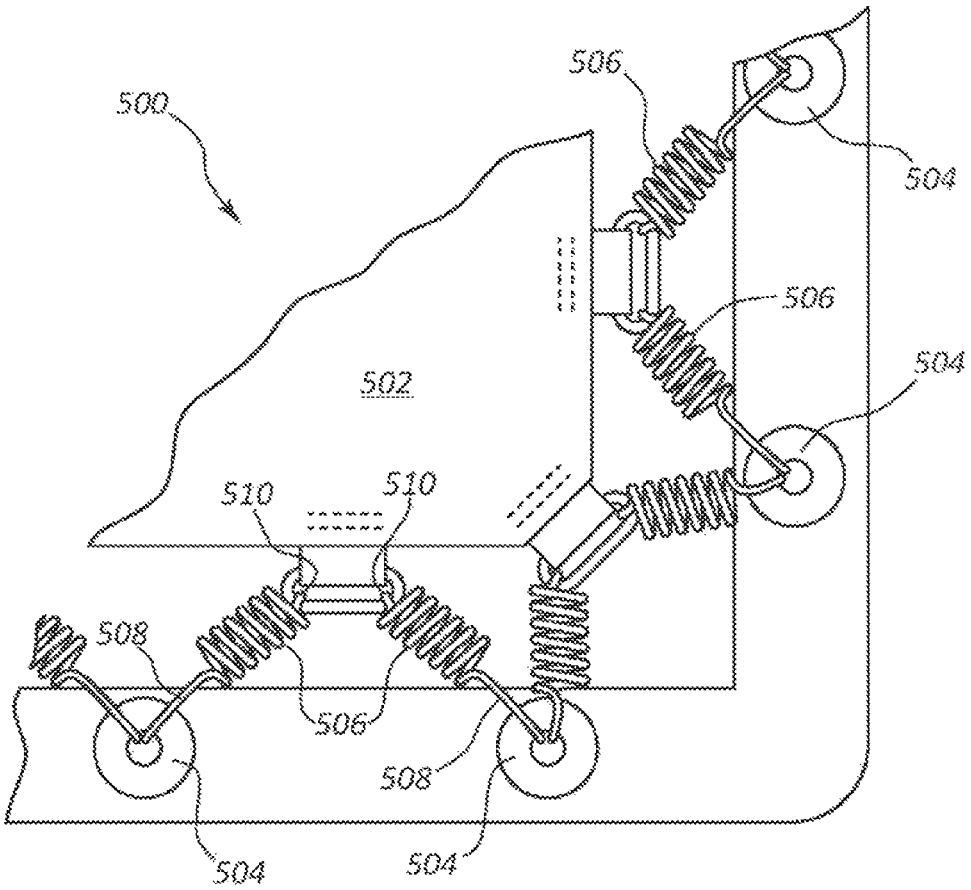
FIG. 5 illustrates a top view of an example resilient connection system in accordance with the present disclosure.

FIG. 5 depicts another example of a resilient connector 500 that can be used with the exercise based stepping device. In this example, the resilient connector 500 connects a trampoline mat 502 to a tubular step tread 504. The resilient connector 500 includes at least one resistive or dampening spring coil 506 with a first end 510 attached to the trampoline mat 502 and a second end 508 attached to the step tread 504.

Figure 6:
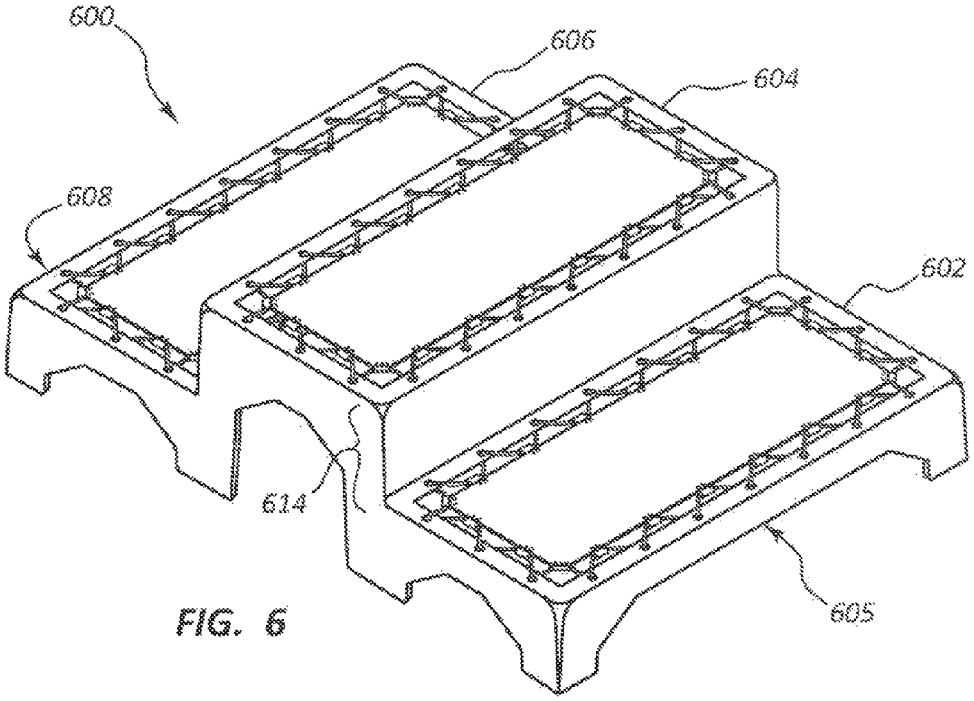
FIG. 6 illustrates a perspective view of an example of a stepper device in accordance with the present disclosure.

FIG. 6 depicts a side view of an example of an exercise based stepping device 600, having more than two step treads. In this example, the stepping device 600 includes a first step tread 602 at a first height relative to the ground or supporting surface (not shown), a second step tread 604 at a second height 605 relative to the ground or supporting surface (not shown), and a third step tread 606 at a third height 608 relative to the ground or supporting surface (not shown). In this example, the height of the first step tread 602 and the height of the third step tread 606 are at approximately the same height relative to the ground or supporting surface (not shown). The first and second step treads 602, 604 are separated vertically by a single riser height 614 Likewise, the first and third step treads 602, 606 are separated vertically by the single riser height 616. However, the first and third step treads 602, 606 may be separated from the second step tread 604 by different riser heights.

Figure 7:
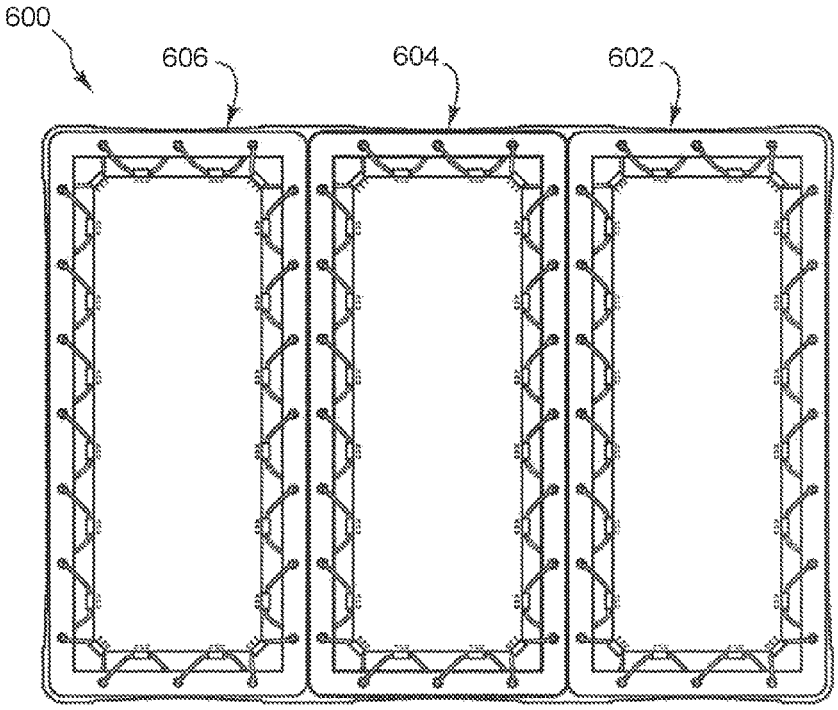
FIG. 7 illustrates a top view of an example of a stepper device in accordance with the present disclosure.

FIG. 7 depicts a top view of an example of a stepping device 600. In this example, the stepping device 600 includes a first step tread 602, a second step tread 604, and a third step tread 606. While not clearly illustrated in this example, each of the step treads 602, 604, 606 are at different heights from their contiguous step. For example, the first step tread 602 is at a different height than the second step tread 604. Likewise, the first step tread 602 is at a different height than the third step tread 606. Each of the first, second, and third step treads 602, 604, 606 are offset from each other. In other words, in this example, the none of the first step tread 602, the second step tread 604, and the third step tread 606 are superjacent to one another.

Figure 8:
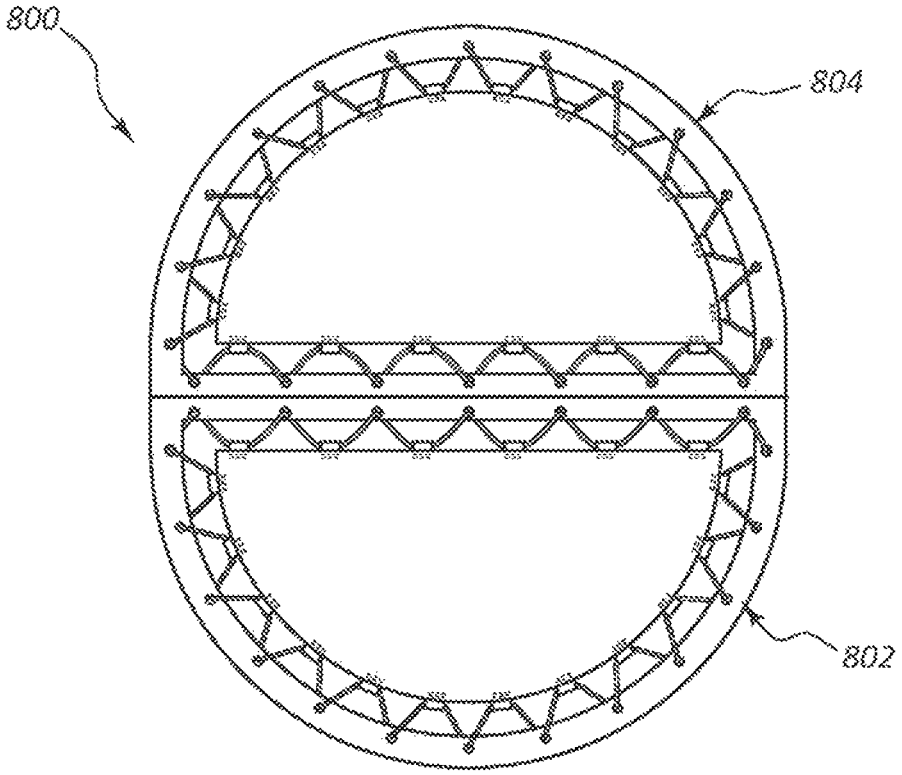
FIG. 8 illustrates a top view of an example of a stepper device in accordance with the present disclosure.

FIG. 8 illustrates a top view of an example exercise based stepper device 800 in accordance with the present disclosure. As illustrated, the stepper device includes a first step tread 802 and a second step tread 804. As described in the above embodiments, the first and second step treads 802, 804 are separated by a single riser height. As shown in FIG. 8, the shape of each step tread may be a semicircle. Alternatively, the respective step treads may assume any perimeter shape including, but in no way limited to, a square, a rectangle, a triangle, an oval, a circle, and the like.

INDUSTRIAL APPLICABILITY

In general, the invention disclosed herein may provide a stepping device that can be used as part of an exercise routine. The stepping device includes a first step tread and a second step tread. The first step tread defines a first opening and the second step tread defines a second opening. A first trampoline mat is suspended in the first opening, and a second trampoline mat is suspended in the second opening. Each of the first and second trampoline mats are attached to their respective step treads through resilient connectors.

A user may use the stepping device as part of an aerobic or anaerobic stepping routine by stepping upward from the ground to the second step tread, and similarly from the second step tread to the first step tread. Likewise, the user may use the stepping device as part of the stepping routine by stepping backwards from the first step tread to the second step tread, and from the second step tread to the floor. When the user stands on either the first or second step tread, the weight of the user applies a load to the trampoline mat. The load is resisted by the resilient connectors which extend under tension until tensile forces of the combined resilient connectors equals the downward load applied by the user's weight. However, even with the resilient members applying the tensile load, the trampoline mat is less stable than a solid platform. As a result, the user uses oblique and other stabilizing muscles to keep his or her balances as the user stands or steps on the either the first or second step tread, thereby enhancing the workout. With conventional stepping devices where the step treads are rigid and solid, the user exerts energy by stepping alone. However, with the present invention, the user has to exerting energy as a result of stepping and an additional amount of energy to stabilize the user to due to lower stability of the suspended trampoline mats. Thus, the user can burn more energy is a shorter amount of time with the present invention than with a conventional stepping device.

The additional workout is achieved during both phases of a stepping workout where the user is stepping forwards onto a higher step tread with a lower stability and when the user is stepping backwards onto a lower step tread with lower stability. While the examples above have been depicted with two step treads, any appropriate number of step treads may be used in accordance with the principles described herein. For example, a third step tread may be incorporated into the stepping device that is positioned at a higher height than the first height of the first step tread. In other examples, the third step tread may be positioned at the same height as either of the first step tread or the second step tread. In such an example, the second step tread and the third step tread may be positioned at the same height and be located on different sides of the first step tread.

The trampoline mat may be suspended in the step tread openings with any appropriate type of resilient connector. In some examples, the resilient connection includes at least one metal spring. In other examples, the resilient connector includes at least one of an elastic cord or fabric, a resilient polymer membrane, and the like. The resilient connectors may hold the trampoline mat taut. In some examples, the trampoline mat does not exhibit a high degree of elasticity, but rather rebound effect of the trampoline mat is caused by the stored potential energy in the resilient connectors. Any appropriate type of trampoline mat may be used in accordance with the principles described herein. For example, the trampoline mat may be woven form webbing, strings, a polypropylene material, or other types of materials.

The trampoline mat may be suspended in the opening such that when a user steps onto the trampoline mat, the trampoline mat is pulled downward by the weight of the user. In such a circumstance, a portion of the trampoline mat may be forced into a cavity that is located below the step tread. In some cases, the trampoline mat may be suspended such that the trampoline mat is flush with the step tread in the absence of a load bearing object forcing the trampoline mat downward. In some examples, the trampoline mat is suspended such that the trampoline mat is above the step tread and a portion of the trampoline mat moves into the opening defined by the step tread when the user steps on the trampoline mat.

The stepping device is sized so that an ordinary user can easily step up and down off of the first and second step treads. A riser height is the vertical distance between contiguous step treads. In some examples, the riser height is between 3.0 inches and 11.0 inches. In other examples, the riser height is between 3.5 inches to 7.0 inches. In yet other examples, the riser height is between 5.0 inches and 6.0 inches. As a comparison, the riser height in stairwells in many residential homes is around 7.0 inches. A riser height above 11.0 inches may be used for extreme plyometric training. On the other hand, a riser height that is smaller than 3.0 inches may be insufficient to provide the aerobic affect desired by the user during a stepper workout.

A cavity is formed under the second opening of the second step tread. The second height of the second step tread is sized to allow the second trampoline mat to move downward into the cavity as the user steps onto the second trampoline. If the trampoline mat moves too far, the user's foot may impact the bottom of the cavity. Thus, the second height at which the second step tread is located is high enough to allow for a cavity with a sufficient depth to avoid the user form impacting the bottom of the cavity during the workout.

Further, the overall width of the stepping device may be any appropriate width. For example, at least one of the step treads may have a width of 36.0 inches or less, 24.0 inches or less, 18.0 inches or less, 15.0 inches or less, 12.0 inches or less, 9.0 inches or less, another appropriate width, or combinations thereof. Further, the overall depth of the stepping device may be any appropriate depth. For example, the overall depth may have a length of 36.0 inches or less, 24.0 inches or less, 18.0 inches or less, 15.0 inches or less, 12.0 inches or less, 9.0 inches or less, another appropriate length, or combinations thereof.

In some examples, the first step tread and the second step tread do not overlap with each other. Thus, the first step tread is offset from the second step tread. In some examples, some surface area of the first step tread overlaps with the surface area of the second step tread. In such examples, while part of the first and second step treads overlap, the first and second trampolines may not overlap with each other. However, in yet other examples, the first and second trampolines may overlap with each other. In such an example, when the stepping device is in an upright position, a portion of the first trampoline is superjacent to the a portion of the second trampoline.

The stepping device may include a solid base construction of any appropriate material. For example, the base of the stepping device may be a molded plastic where the components that form the tread openings and cavities are integrally formed with each other. In another example, the step treads may be positioned in place with an open frame. In such an example, a plurality of legs may raise the first and second step treads to their appropriate heights. In some examples, both the first and second step treads are supported by the same leg. In those examples with an open frame structure, the stepping device may include parts that can be assembled and disassembled for storage, shipping, or other events.

What is claimed is:

1. A stepping device, comprising:

a solid base, the solid base including:

a first step tread at a first step height, the first step tread defining a first opening;

a first trampoline mat elastically suspended within the first opening;

a second step tread at a second step height, the second step tread defining a second opening;

wherein the second step tread is spaced a single riser height lower than the first step height;

a second trampoline mat elastically suspended within the second opening; and a cavity located below the second step tread;

wherein the second trampoline mat is configured to be suspended such that the second trampoline mat is flush with the second step tread in the absence of a load bearing object forcing the second trampoline mat downward;

wherein the second trampoline mat is configured to be forced into the cavity when the load bearing object is on the second trampoline mat and a depth of the cavity is sufficient to keep a user from impacting a bottom of the cavity during a workout;

wherein the first step tread and the second step tread do not overlap with each other.

2. The stepping device of claim 1, wherein the single riser height is between 3.0 and 11.0 inches.

3. The stepping device of claim 1, wherein the single riser height is between 4.5 and 7.0 inches.

4. The stepping device of claim 1, further comprising a first resilient connector that connects the first trampoline mat to the first step tread, and a second resilient connector that connects the second trampoline mat to the second step tread.

5. The stepping device of claim 4, wherein at least one of the first resilient connector and the second resilient connector exhibits a spring force when under tension.

6. The stepping device of claim 1, wherein the first step height is between 6.0 inches and 1.5 feet.

7. The stepping device of claim 1, wherein the first step height is between 6.0 inches and 11.0 inches.

8. The stepping device of claim 1, wherein the first step height is between 3.0 inches and 7.0 inches.

9. The stepping device of claim 1, wherein the first step height is between 3.0 inches and 5.0 inches.

10. The stepping device of claim 1, wherein the first step tread is aligned with the second step tread.

11. The stepping device of claim 10, wherein the first step tread is contiguous with the second step tread.

12. The stepping device of claim 1, wherein the first step tread is offset from the second step tread.

13. The stepping device of claim 1, further comprising a third step tread.

14. The stepping device of claim 13, wherein the third step tread defines a third opening, and the third step tread further comprises a third trampoline mat suspended in the third opening.

15. The stepping device of claim 13, wherein the third step tread is located at the second step height.

16. A stepping device, comprising:

a solid base construction, the solid base construction including:

a first step tread at a first step height and defining a first opening;

a first trampoline mat suspended within the first opening;

a second step tread at a second step height and defining a second opening;

wherein the second step tread is spaced a single riser height lower than the first step height;

a second trampoline mat suspended within the second opening;

a first resilient connector that connects the first trampoline mat to the first step tread;

a second resilient connector that connects the second trampoline mat to the second step tread;

wherein at least one of the first resilient connector and the second resilient connector exhibits a spring force when under tension;

wherein the first step tread is offset from the second step tread and is contiguous with the second step tread; and a cavity located below the second step tread;

wherein the second trampoline mat is configured to be suspended such that the second trampoline mat is flush with the second step tread in the absence of a load bearing object forcing the second trampoline mat downward;

wherein the second trampoline mat is configured to be forced into the cavity when the load bearing object is on the second trampoline mat and a depth of the cavity is sufficient to keep a user from impacting a bottom of the cavity during a workout;

wherein the first step tread and the second step tread do not overlap with each other.

17. The stepping device of claim 16, wherein the single riser height is between 4.5 and 9.0 inches.

18. The stepping device of claim 16, wherein the first step height is between 6.0 and 11.0 inches.

19. The stepping device of claim 16, wherein the second step height is between 3.0 and 5.0 inches.

20. The stepping device of claim 16, wherein the first step tread is aligned with the second step tread.

21. A stepping device, comprising:

a solid base construction, the solid base construction including:

a first step tread at a first step height that is between 6.0 and 11.0 inches, the first step tread defining a first opening;

a first trampoline mat suspended within the first opening;

a second step tread at a second step height, the second step tread defining a second opening;

wherein the second step tread is spaced apart at a height between 4.5 and 7.0 inches lower than the first step height, the second step height being between 3.0 and 5.0 inches.

a second trampoline mat suspended within the second opening;

a first resilient connector that connects the first trampoline mat to the first step tread;

a second resilient connector that connects the second trampoline mat to the second step tread;

wherein at least one of the first resilient connector and the second resilient connector exhibits a spring force when under tension;

wherein the first step tread is offset from the second step tread and is contiguous with the second step tread; and a cavity located below the second step tread;

wherein the second trampoline mat is suspended such that the second trampoline mat is flush with the second step tread in the absence of a load bearing object forcing the second trampoline mat downward;

wherein the second trampoline mat is forced into the cavity when the load bearing object is on the second trampoline mat and a depth of the cavity is sufficient to keep a user from impacting a bottom of the cavity during a workout;

wherein the first step tread and the second step tread do not overlap with each other.

* * * * *